US007921786B2

(12) United States Patent
Sund et al.

(10) Patent No.: US 7,921,786 B2
(45) Date of Patent: Apr. 12, 2011

(54) GRATING SYSTEM AND SIDEWALL SEAL ARRANGEMENT FOR OSCILLATING GRATE STOKER

(75) Inventors: John Sund, Oakham, MA (US); Larry Pace, Enfield, CT (US); Kevin Toupin, Princeton, MA (US)

(73) Assignee: Riley Power Inc., Worcester, MA (US)

( * ) Notice: Subject to any disclaimer, the term of this patent is extended or adjusted under 35 U.S.C. 154(b) by 564 days.

(21) Appl. No.: 11/801,531

(22) Filed: May 10, 2007

(65) Prior Publication Data

US 2008/0276843 A1 Nov. 13, 2008

(51) Int. Cl.
*F23H 7/14* (2006.01)
*F23H 7/18* (2006.01)

(52) U.S. Cl. ..... 110/278; 110/328; 126/174; 126/155; 126/163 R

(58) Field of Classification Search ..... 110/109, 110/267, 268, 278, 281; 266/178, 179; 126/152 B, 126/167, 174
See application file for complete search history.

(56) References Cited

U.S. PATENT DOCUMENTS

| | | | | |
|---|---|---|---|---|
| 1,939,177 A | | 12/1933 | Losch | |
| 2,583,433 A | | 1/1952 | Losch | |
| 3,005,446 A | | 10/1961 | Kock | |
| 3,042,390 A | * | 7/1962 | Rausch et al. | 266/179 |
| 3,126,846 A | | 3/1964 | Wagner | |
| 3,251,457 A | | 5/1966 | Dumbaugh | |
| 3,395,655 A | | 8/1968 | Guy | |
| 4,239,029 A | * | 12/1980 | Martin et al. | 126/163 R |
| 4,250,818 A | | 2/1981 | Sigg | |
| 4,287,056 A | | 9/1981 | Dumbaugh et al. | |
| 4,326,469 A | | 4/1982 | Reschly | |
| 4,389,978 A | | 6/1983 | Northcote | |
| 4,437,452 A | | 3/1984 | Reschly | |
| 4,492,629 A | | 1/1985 | Dumbaugh | |
| 4,576,101 A | | 3/1986 | Reschly | |
| 4,633,849 A | | 1/1987 | Knox | |
| 4,774,893 A | | 10/1988 | Dumbaugh | |
| 4,844,289 A | | 7/1989 | Dumbaugh | |

(Continued)

FOREIGN PATENT DOCUMENTS

DE 143465 8/1980

(Continued)

OTHER PUBLICATIONS

International Search Report.
Written Opinion of the International Searching Authority (ISA).

*Primary Examiner* — Kenneth B Rinehart
*Assistant Examiner* — David J Laux
(74) *Attorney, Agent, or Firm* — Edwards Angell Palmer & Dodge LLP

(57) ABSTRACT

The invention includes a grate system for a boiler. The grate system includes a grate unit and a side header guard. The grate unit supports fuel during combustion thereof, and has an upper surface, a lower surface, and upturned lateral edges. The side header guard is arranged along a side wall of the boiler and has upwardly and downwardly projecting fin portions. The upwardly projecting fin portion is adapted and configured to extend over and protect the boiler side wall from abrasion by fuel. The downwardly projecting fin portion is adapted and configured to extend over the upturned lateral edge of the grate unit, inhibiting passage of fuel therebetween.

18 Claims, 8 Drawing Sheets

U.S. PATENT DOCUMENTS

| | | | | |
|---|---|---|---|---|
| 4,899,669 | A | 2/1990 | Dumbaugh | |
| 4,936,231 | A | 6/1990 | Johnson | |
| 4,960,229 | A | 10/1990 | Dumbaugh | |
| 4,987,837 | A | 1/1991 | Reschly et al. | |
| 5,046,643 | A | 9/1991 | Dumbaugh | |
| 5,265,543 | A | 11/1993 | Hamaker et al. | |
| 5,361,892 | A | 11/1994 | Hamaker et al. | |
| 5,383,446 | A * | 1/1995 | Whitfield | 126/152 R |
| 5,882,189 | A * | 3/1999 | Fehsenmayr et al. | 432/78 |
| 6,220,190 | B1 * | 4/2001 | Dumbaugh et al. | 110/328 |
| 6,405,661 | B1 | 6/2002 | Mancini | |
| 6,655,304 | B1 | 12/2003 | Barlow | |

FOREIGN PATENT DOCUMENTS

| | | | |
|---|---|---|---|
| JP | 07145921 | A | 6/1995 |
| JP | 2002-317903 | A | 10/2002 |

* cited by examiner

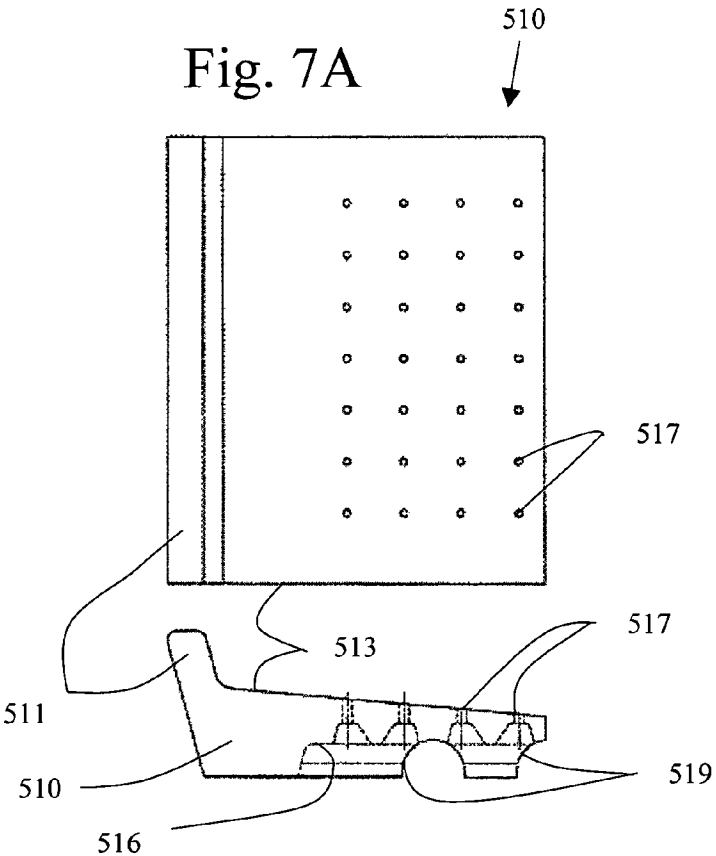
Fig. 7A
Fig. 7B
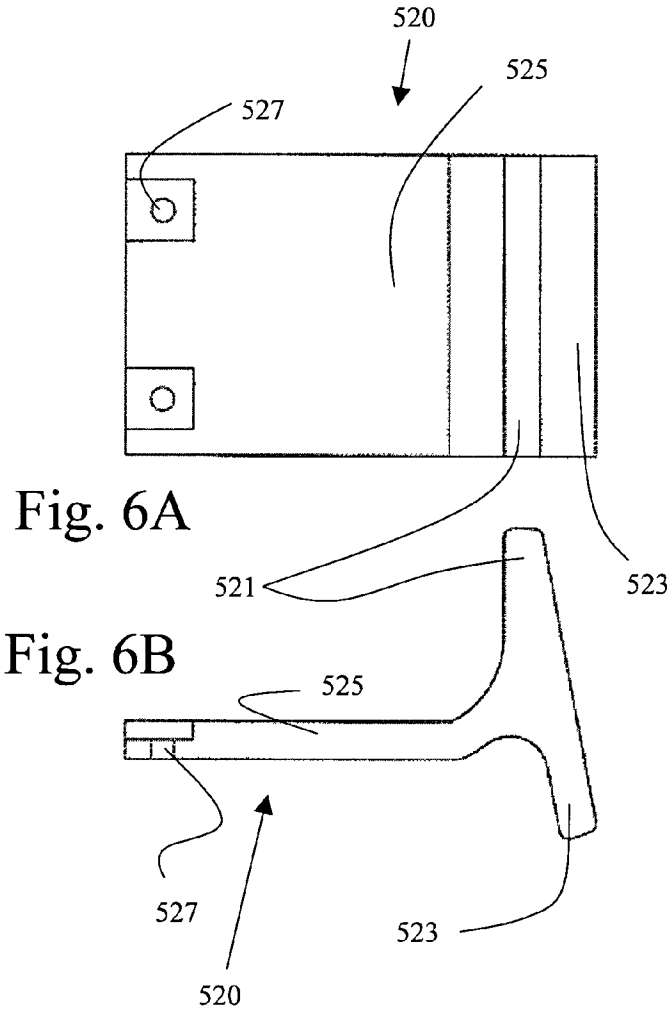
Fig. 6A
Fig. 6B

GRATING SYSTEM AND SIDEWALL SEAL ARRANGEMENT FOR OSCILLATING GRATE STOKER

BACKGROUND OF THE INVENTION

1. Field of the Invention

The present invention generally relates to boiler systems, and more particularly to a water-cooled oscillating grate system for a boiler for use with solid fuels.

2. Description of Related Art

Large-scale boilers are used in industrial processes and in power generation, among other applications. Fuel is fed into such boilers, and handled by an automatic or remotely operated grating system. Such gratings are typically movable or vibrating to facilitate combustion by mixing solid fuel held thereon. The gratings for stokers used in large-scale boiler systems are formed of multiple sections approximately 2 meters in width. Typically, steep walled hoppers are required underneath the gratings to collect ash siftings that fall through openings between grate sections. Also, multiple water pipes typically project from each end of the grate to stationary water headers. This arrangement adds cost, results in excess transmission of vibrations, and results in failure due to fatigue in the water pipes. In many vibrating grate systems excessive vibration is coupled to the boiler and the surrounding structure. This occurs, particularly when the grate is not effectively counter-balanced or isolated from the boiler.

U.S. Pat. No. 6,220,190 to Dumbaugh et al ("Dumbaugh"). addresses many of the foregoing problems with typical systems. In Dumbaugh, as illustrated in FIG. 8, a water-cooled grate unit 104 engages a boiler shell 118, at which interface an appropriate flexible connection is provided. Perimeter sealing connections between the boiler 102 and grate unit 104 are provided by a labyrinth type seal 170 and a flexible fabric expansion joint connection 174. The perimeter bladed labyrinth type seal connection 170 is provided in-line with the vibratory stroke angle of the vibration drive isolation assembly 112. The perimeter flexible fabric expansion joint 174 provides sealing for the boiler 102 thermal expansion movement. All four walls of air plenum chamber 108 are directly attached to the grate surface 106 with all four walls to provide a tight air seal.

In accordance with Dumbaugh, however, a protruding element, sometimes referred to as a "chill bar" is included on the boiler feed water supply line 119 for pushing fuel toward the middle of the grate. The fuel would otherwise approach a gap between the grating and the boiler. Although this arrangement may be suitable, such an arrangement may not lend itself easily to retrofit of an existing boiler. Additionally, lateral fuel migration is inhibited best when the boiler expands to the position indicated in FIG. 8 by dotted lines. Until the boiler reaches operating temperature, therefore, fuel and combustion gases may more easily escape. Further, the protrusion provided on the boiler feed water supply line 119 is not easily replaceable. Accordingly, if it is abraded by moving fuel, major repairs may be necessary, resulting in unnecessary boiler down time.

A need therefore exists to provide an improved water-cooled vibrating grate system that minimizes the vibration coupled to the boiler and the surrounding structure, which also addresses the need for a practical, reliable and easily maintained seal between such a grate system and boiler. The present invention provides a solution for these problems.

SUMMARY OF THE INVENTION

The purpose and advantages of the present invention will be set forth in and apparent from the description that follows.

Additional advantages of the invention will be realized and attained by the methods and systems particularly pointed out in the written description and claims hereof, as well as from the appended drawings.

The present invention relates to a seal arrangement for use between an oscillating grate of a stoker apparatus and a boiler with which it is used. The seal arrangement presented herein facilitates vibration isolation between the vibrating grate and the boiler, while effectively inhibiting release of combustion gases through the seal.

To achieve these and other advantages and in accordance with the purpose of the invention, as embodied, the invention includes a grate system for a boiler. The grate system includes a grate unit and a side header guard. The grate unit supports fuel during combustion thereof, and has an upper surface, a lower surface, and upturned lateral edges. The side header guard is arranged along a side wall of the boiler and has upwardly and downwardly projecting fin portions. The upwardly projecting fin portion is adapted and configured to extend over and protect the boiler side wall from abrasion by fuel. The downwardly projecting fin portion is adapted and configured to extend over the upturned lateral edge of the grate unit, inhibiting passage of fuel therebetween.

The upper surface of the grate near the outer lateral edges thereof can be adapted and configured to slope toward a centerline of the grate unit so as to urge fuel carried thereon away from lateral edges of the grate unit. The side header guard can further include a main body flange configured and adapted to enable mounting of the side header guard to a grate support frame.

The grate system can further include combustion-proof material arranged between the grating unit and the side header guard, further inhibiting passage of fuel or combustion gases therebetween. The combustion-proof material can be retained, in part, by a floating isolation element bridging between the grate unit and a support therefor.

The grate system can further include combustion-proof material arranged between the side header guard and the boiler side wall, inhibiting passage of fuel or combustion gases therebetween.

Air-flow apertures can be defined in the grate unit to allow air for combustion to pass through the grate unit.

The grate system can further include an air plenum unit positioned under and attached to said grate unit. The air plenum unit can be adapted and configured to be coupled to an air supply for providing combustion air through said air-flow apertures. The air plenum unit can further includes a plurality of zones with each of said zones having an associated air flow control damper for controlling combustion air flow through said zone to said grate surface.

The grate unit can include a plurality of grate clips, which together constitute the majority of the grate surface.

The grate system can also include a vibration drive isolation assembly associated with said grate unit for vibrating said grate unit and isolating said grate unit from said boiler.

A plurality of water-cooling pipes can be provided for supporting the grate unit. The plurality of water-cooling pipes can be configured and adapted to be coupled to a water supply.

The grate surface can be disposed generally horizontally and wherein said vibration drive isolation assembly includes a stroke angle of at least 20 degrees from the horizontal.

The grate system can further include a vibration drive isolation assembly for vibrating said grate unit. The vibration drive isolation assembly including a longitudinally extending counterbalance member. A plurality of drive springs can be supported by said counterbalance member with the drive springs being distributed across at least the width of said grate unit. At least one vibratory drive motor can be installed on said counterbalance member, and a plurality of isolation springs provided for supporting said longitudinal counterbalance member.

The grate system can also include a plurality of water-cooling pipes supporting the grate unit and a water-cooling inlet header supplying cooling water. The plurality of water-cooling pipes and a water-cooling outlet header, in such an embodiment receives cooling water from said plurality of water-cooling pipes.

Additionally, in accordance with the invention, the grate unit and side header guard can be supported independently from the boiler.

It is to be understood that both the foregoing general description and the following detailed description are exemplary and are intended to provide further explanation of the invention claimed.

BRIEF DESCRIPTION OF THE DRAWINGS

The accompanying drawings, which are incorporated in and constitute part of this specification, are included to illustrate and provide a further understanding of the method and system of the invention. Together with the description, the drawings serve to explain the principles of the invention, wherein:

FIG. 6A is a top view of a side header guard for use with the sealing arrangement of FIG. 5;

FIG. 6B is an end view of the side header guard of FIG. 6A;

FIG. 7A is a top view of a lateral edge grate clip for use with the sealing arrangement of FIG. 5;

FIG. 7B is an end view of the lateral edge grate clip of FIG. 7A; and

DETAILED DESCRIPTION

Reference will now be made in detail to the present preferred embodiments of the invention, an example of which is illustrated in the accompanying drawings. The method and corresponding steps of the invention will be described in conjunction with the detailed description of the system.

The present application includes improvement on existing related technology, as exemplified by U.S. Pat. No. 6,220,190 issued Apr. 24, 2001, which patent is hereby incorporated by reference in its entirety.

Figure 1:
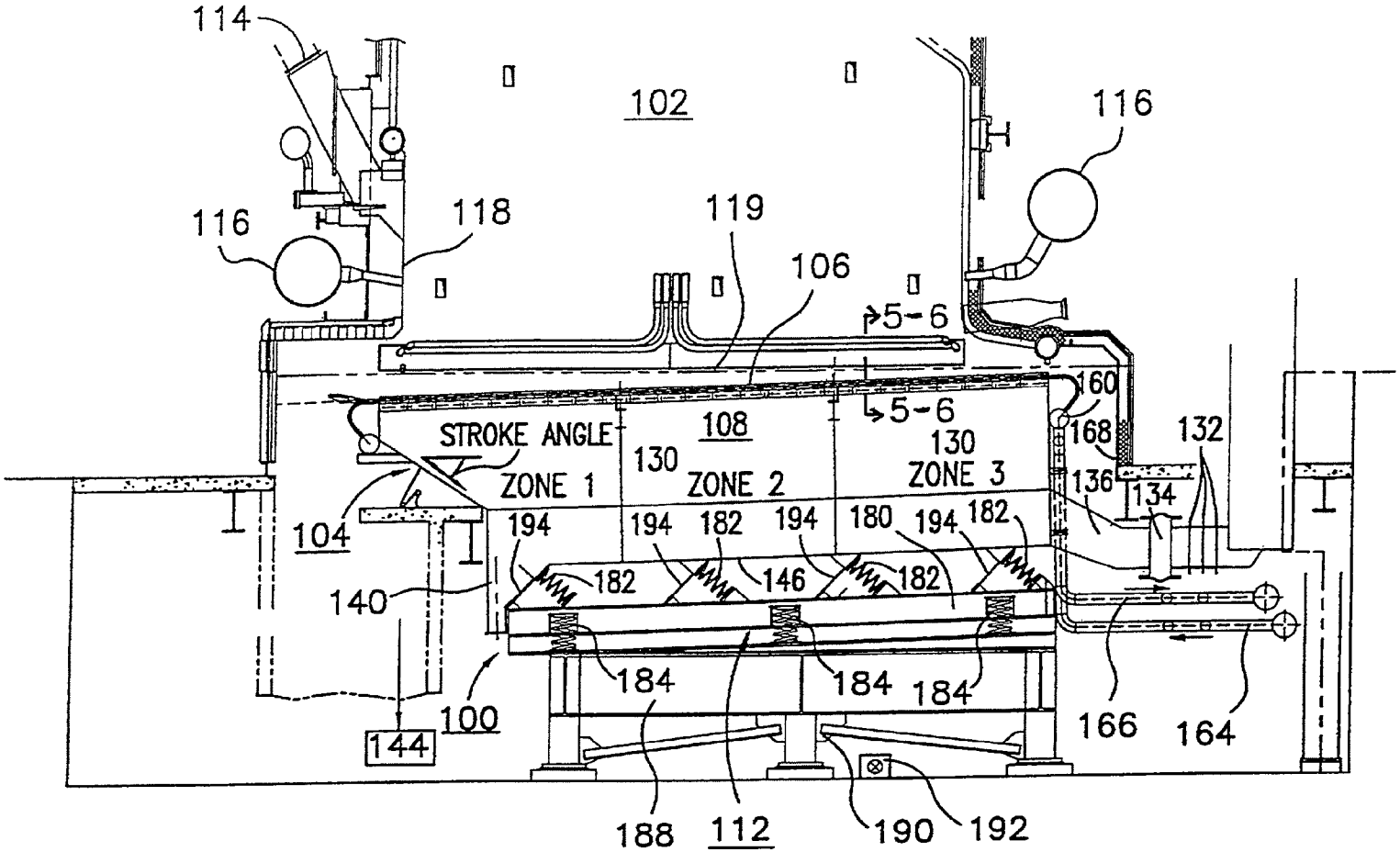
FIG. 1 (Prior Art)
FIG. 1 is a fragmentary side elevational view of a boiler including a water-cooled, vibrating grate system arranged in accordance with the present invention.

FIG. 1 illustrates a vibrating grate system generally designated by reference character 100 and arranged in accordance with the present invention in a boiler 102. In accordance with the invention, the grate system 100 includes a grate unit generally designated 104. Among its primary components, the grate unit 104 has upper and lower surfaces and can include an air plenum 108 and a plurality of water cooling tubes 110. The grate unit 104, in conjunction with the air plenum 108 is an enclosed, integral unit through which combustion air can flow. The grate system 100 can be fitted with a vibration isolated drive system generally designated by 112, in accordance with the invention. As shown in FIG. 1, the boiler 102 includes a fuel inlet 114 to permit fuel, such as biomass fuel, to be fed downwardly onto the grate surface 106. The boiler includes multiple overfire air ports 116 for supplying overfire air within the boiler shell 118. It should be understood that the present invention is not restricted to use with a particular boiler or furnace arrangement.

In accordance with features of the invention, the grate system 100 is suitable for use in firing biomass fuels, which vary in moisture content and heating value. Each fuel requires its own proportion of combustion air quantity, combustion air temperature, degree of oscillation, and speed of fuel travel on the grate. The grate system 100 allows the use of high temperature under-grate air for high moisture fuels, with grate components being protected from overheating via water cooling tubes. The constant flow of cooling water through pipes 110 is also sufficient protection for the grate surface 106 when firing the boiler with auxiliary fuel burners properly located above the grate surface 106. The grate surface 106 itself does not require a layer of insulating material for protection. To conserve energy, boiler feed water (supply line 119 in FIG. 1) is generally used for grate cooling, however it should be understood that other water sources may also be used.

Figure 2:
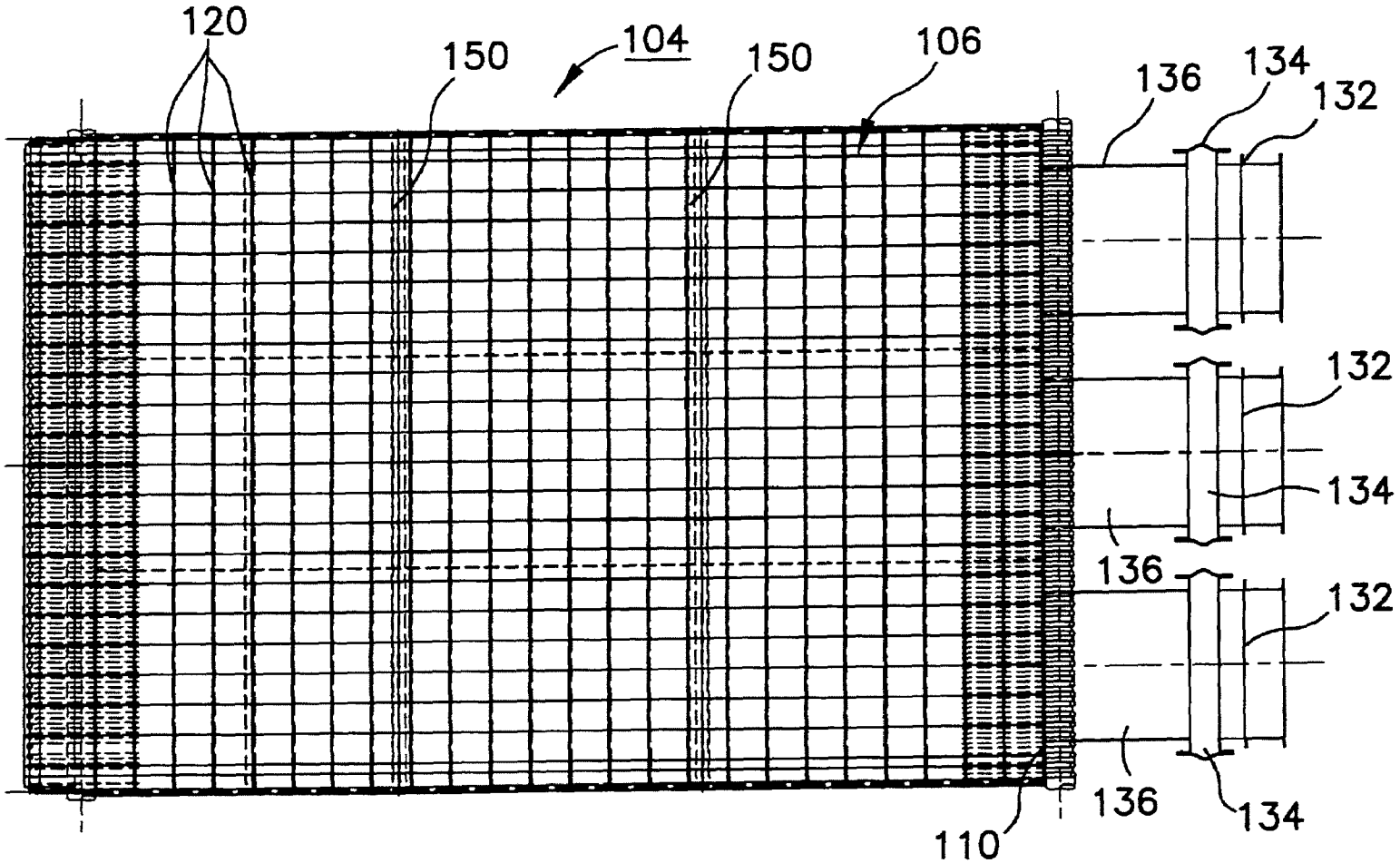
FIG. 2 (Prior Art)
FIG. 2 is a top elevational view of the water-cooled oscillating grate assembly of FIG. 1 in accordance with the present invention.
Figure 2A:
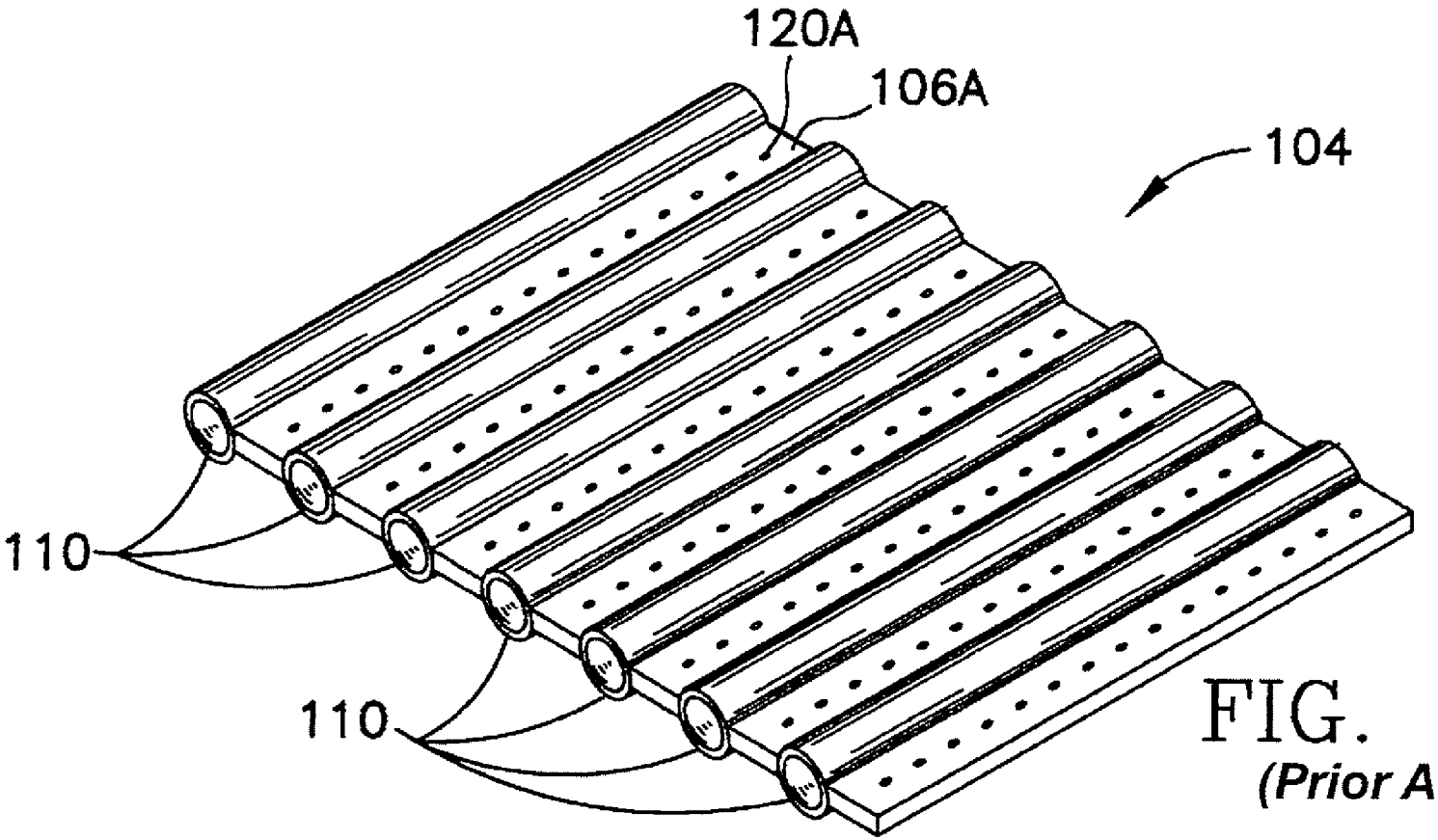
FIG. 2A (Prior Art)
FIG. 2A is an isometric view of an alternative grate surface together with water cooling pipes of the water-cooled oscillating grate assembly of FIG. 1 in accordance with the present invention.

Referring to FIGS. 2, 2A, 3 and 4, in accordance with the invention, the top grate surface 106 of grate unit 104 includes a plurality of air-receiving openings 120 for receiving combustion air from the air plenum 108. In FIG. 2A, there is shown an alternative, water jacketed air-permeation flat deck 106A forming the grate top surface of the grate unit 104. The flat deck 106A similarly includes a plurality of air-receiving openings 120A for receiving combustion air from the air plenum 108.

As can be seen in FIGS. 4, 5, 7A and 7B, the grate surface 106 can be composed of a plurality of grate clips 122 made of high temperature cast material, seated on water cooling tubes 110. The clips can be mutually sealed to one another and/or to the cooling tubes 100 with a high thermal conductivity grout. Grate clips 122 provide a high pressure drop grate surface 106 for better air distribution through the grate unit 104.

In accordance with features of the invention, the air plenum unit 108 can be adapted to include multiple air flow zones 130 beneath the grate surface 106 to allow for balancing the air flow across the front, middle and rear grate sections. Siftings fall down into the plenum 108 and are simultaneously conveyed to discharge openings 140 in the plenum 108 by directional vibratory motion provided by assembly 112.

The incoming air plenum 108 is installed directly under the water-cooled grate surface 106 and can be an integral part of the grate unit 104. This plenum 108 receives the incoming air and properly distributes this air to predefined sections of the grate. The vibratory drive assembly 112 is located underneath the air plenum 108.

Figure 3:
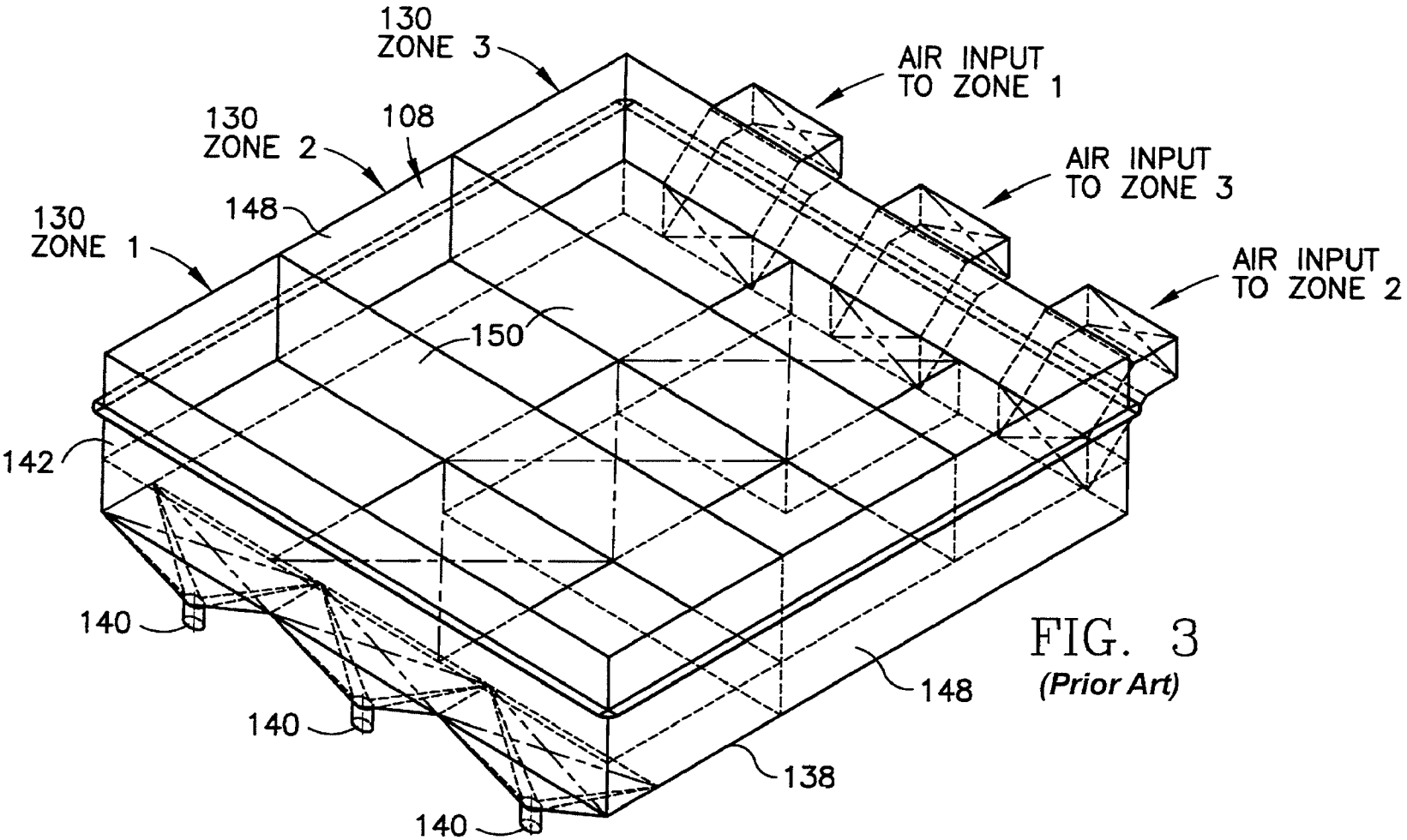
FIG. 3 (Prior Art)
FIG. 3 is an isometric view of a plenum chamber of the water-cooled oscillating grate assembly of FIG. 1 in accordance with the present invention.

As shown in FIGS. 1 and 3, the grate air flow can be arranged so as to be controlled in three air plenum zones 130 consisting of front, middle and rear zones (labeled ZONE 1, ZONE 2 and ZONE 3 in FIGS. 1 and 3). Each zone 130 has an associated air flow control damper 132 located upstream of an expansion joint 134 in a respective zone air supply line 136. As a result, air flow can be biasing to improve the air to fuel mixing. When needed, and in addition to the multiple zones, air distribution in either the longitudinal or transverse direction can be controlled with added sleeves constructed of tubular type perforated plate (not shown). A flat bottom conveying pan 138 forms the lower section of the air plenum 108. The bottom 138 of the air plenum 108 acts as an ash siftings collector for any passed particles being burned on top of the grate unit 104. This eliminates the need for standard ash collecting hoppers used in typical systems. The ash siftings are collected and simultaneously conveyed to the discharge end of the grate unit 104. The grate ash siftings to the air plenum 108 are directionally vibrated to a plurality of front siftings discharge openings 140 at a discharge end 142 of the air plenum unit 108. An air plenum ash siftings receiving hopper 144 can be cleaned on-line. Since the grate unit 104 carries the conveyed ash and the cooling water load, the lower enclosure portion of 146 of grate unit 104 must provide adequate structural strength to enable grate unit 104 to be driven by the vibratory drive configuration 112. In the illustrated embodiments, the lower enclosure portion of 146 is a structural grid frame. Transverse and longitudinal structural beams supporting the frame 146 are connected to the vertical sidewalls 146 of the air plenum 108. The vertical walls 150 between the air plenum zones 130 are structurally reinforced with added columns appropriately spaced internally and externally.

The top grate surface 106 is preferably air permeated and water-cooled via multiple water cooling pipes 110. As shown in FIG. 1, the grate surface 106 is installed generally horizontally. Alternatively, the grate surface 106 can be installed slightly inclined, if preferred. A pair of water headers 160 and 162 are included as an integral part of the grate unit 104 and vibrate with unit 104, as best shown in FIG. 4.

Figure 4:
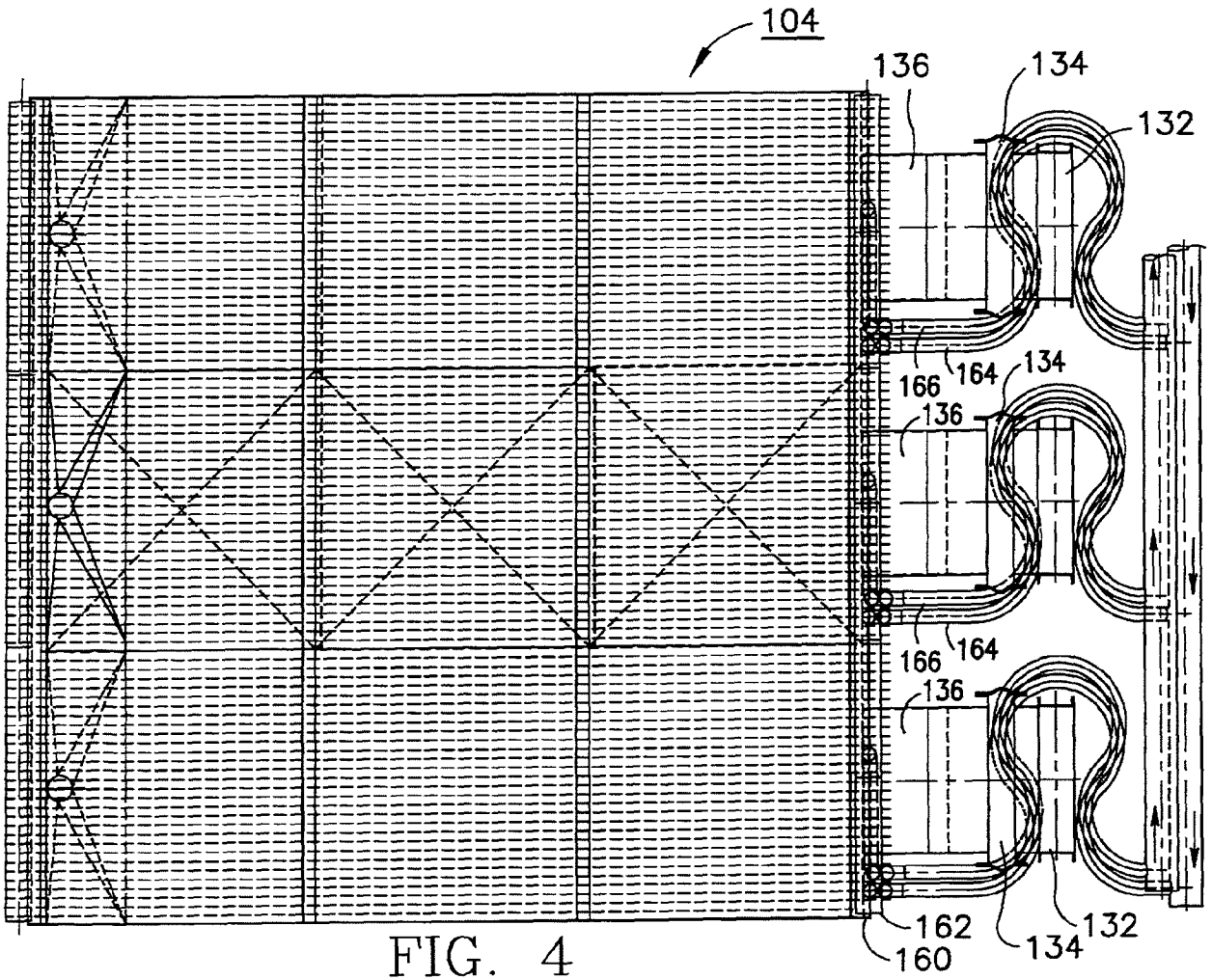
FIG. 4 (Prior Art)
FIG. 4 is a top elevational view illustrating water-cooling components of the water-cooled oscillating grate assembly of FIG. 1 in accordance with the present invention.

Referring to FIGS. 1 and 4, an inlet water header 160 and an outlet water header 162 installed on one end of the grate unit 104 are respectively connected to inlet and outlet water lines 164 and 166. Since the inlet header 160 and outlet water header 162 are an integral part of the grate unit 104, the headers 160 and 162 vibrate with the unit 104. The water lines 164 and 166 are flexibly connected to the two headers 160 and 162.

Referring to FIG. 1, the vibration drive isolation system or assembly 112 is arranged to minimize vibration to exterior plant equipment. Vibration drive isolation system 112 includes a longitudinal counterbalance member 180, a plurality of drive springs 182 supported by counterbalance member 180 and a plurality of isolation springs 182 supporting the counterbalance member 180. A structural steel base 188 supports the isolation springs 184 and is isolated from the boiler 102. The vibration unit has the following capabilities: Variable speed motor control capable for adjusting the vibration intensity, and control capability of ramping up and ramping down the vibration intensity during a timed cycle. The result is vibration system can easily be tuned and emissions can be controlled during a vibrating cycle.

Both the time between oscillations and the intensity of the oscillation can be controlled with an easy control panel adjustment of controller 192. They require no mechanical adjustment of eccentrics. Typically, oscillation cycles are approximately five minutes apart with oscillation five to ten seconds long. The times will vary depending on the fuel characteristics and the moisture content. Actual motion of grate unit 104 is about a quarter of an inch, and the entire grate surface 106 oscillates at once. The grate surface 106 does not have to be broken into separate oscillating zones. Variable oscillation control also allows the five to ten second oscillating cycles to start slowly and build up to full intensity.

The electric motors 190 of the vibratory drive assembly 112 are not attached to the grate unit as conventionally done. The dynamic counter-balance 180 is longitudinal and positioned under the combination of the steel coil drive springs 184 and multiple flat bar type of stabilizers 196. The assembly 112 is supported from the longitudinal counter-balance 180 by the appropriately spaced isolating springs 184 mounted in compression and appropriately spaced along its length. The vibratory motors with shaft mounted eccentric weights 190 are either installed on each side of the counter-balance 180, or combined together, and placed underneath the counter-balance, or if one motor 190 is used, it is preferably put on top of the counter-balance 180 near the mid-point of the counter-balance 180.

The steel coil type drive springs 182 are distributed across the width and along the length of the underside of the enclosed vibrating grate unit 104. The drive springs 182 are combined with flat bar type stabilizers 194 to assure a uniform stroking action. The flat bar type stabilizers 194 are used to guide the movement of the stiff drive springs 182.

The drive springs 182 are sub-resonant tuned to cause them to inherently work harder under load, where sub means under and Resonant means natural frequency. Therefore, "Sub-resonant" means the maximum running speed of the vibratory motors 190 is always under the natural frequency of the combined drive springs. For example, if the top motor speed is 570 RPM, which in this instance is the same as CPM, then the natural frequency of all the drive springs 182 would be, for example, 620 CPM. While 570 CPM is preferred, other frequencies such as 720 CPM, 900 CPM or 1200 CPM, might be useful for various applications.

The axial centerline of the steel coil drive springs 182 is provided in line with the desired stroke angle, but the axial centerline of the stabilizer 194 is perpendicular to the stroke angle. A stroke angle is illustrated with the plenum unit 108 in FIG. 1 and labeled STROKE ANGLE. By utilizing paralleled counter-balance or structural beams 180 as a longitudinal configuration, the enclosed vibrating grate unit 104 is dynamically counter-balanced. The structural Natural Frequency of the counter-balance assembly will be at least 1.4 times the maximum speed of the motors, but preferably will exceed it. In this instance, the RPM of the motor 190 is the same as the vibrating CPM of the enclosed grate unit 104.

Relatively soft steel coil type isolation springs 184 preferable are used to support the longitudinal counter-balance 180 which in turn supports the enclosed vibrating grate unit 104 above it. Preferable needed input power is proved by two, three phase, A-C squirrel cage vibratory motors 190 by either installing motors 190 on each side of the dynamic counter-balancing member 180.

Electrical adjustment of conveying speed is provided by the controller implements either as a variable voltage or an adjustable frequency type of electrical control. The conveying speed of the ash over the vibrating grate unit 104 can be electrically adjusted.

In operation, the vibratory motor(s) 190 are energized and the shaft mounted eccentric weights are accelerated to full speed. The force output of the rotating eccentric weights excites or induces all the stiff steel coil drive springs 182 and flat bar stabilizers 194 to vibrate back and forth in a straight line. The speed (RPM) of the vibratory motors 190 is the same as the vibrating frequency (CPM) of the drive springs 182. This happens even though the natural frequency of the drive springs 182 is above the motor speed. Consequently, the enclosed grate unit 104 vibrates at a prescribed amount of linear stroke at the wanted angle, which is usually 45 degree. As an equal reaction to the vibratory movement of enclosed grate unit 104, the counter-balance member 180 inherently moves in an opposite direction. Thus, the opposing dynamic forces cancel one another. The counter-balance 180 freely moves or floats on top the soft isolation springs 184 supporting it.

A resulting directional, straight line stroke on the enclosed grate unit 104 induces the ash particles to unidirectionally move forward simultaneously over the top grate surface 106 and the bottom surface 138 of air plenum 108. This ash movement is the result of a series of hops or pitches and catches by the applied vibration. Normally, the ash first settles on the grate. Then, it is gradually moved forward by repetitive on and off cycles of applied vibration. For example, the ash is moved 3 feet every 6 minutes. Alternatively, the ash movement over the grate surfaces could be electrically adjusted via adjustment of motor operation by controller 192 to provide, for example, a conveying speed of 0.5 FPM. The ash conveyed on the air permeated grate top 106 discharges into vertical chutes (not shown). The ash siftings that fall through any openings 120 in the grate surface 106 drop onto the bottom conveying pan 138 of the air plenum. When the vibratory conveying action is applied, these ash siftings move forward. Eventually, these particles fall down through outlets 140 located near the discharge end of the grate unit 104.

Figure 5:
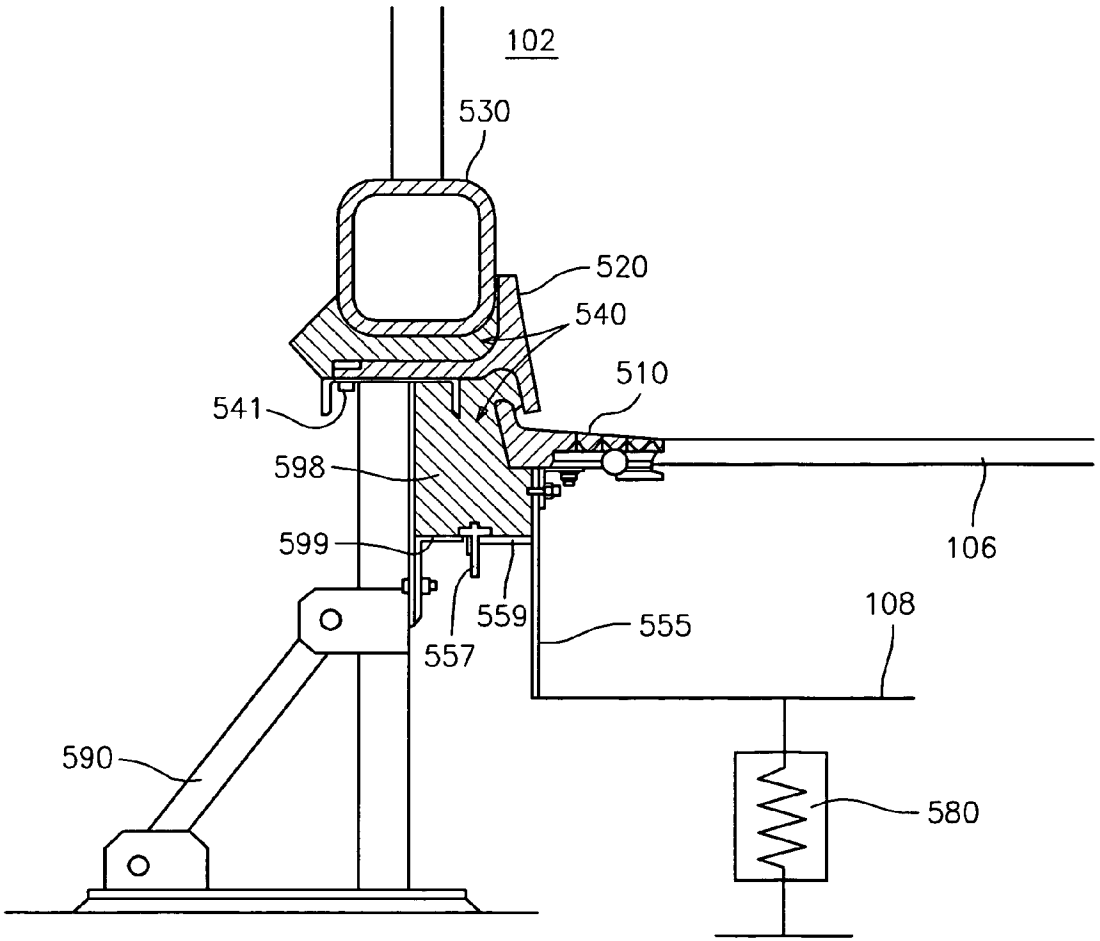
FIG. 5 is a side sectional views taken along line 5-6 of FIG. 1 illustrating a grate to boiler sealing arrangement of the water-cooled oscillating grate assembly of FIG. 1 in accordance with the present invention.
Figure 8:
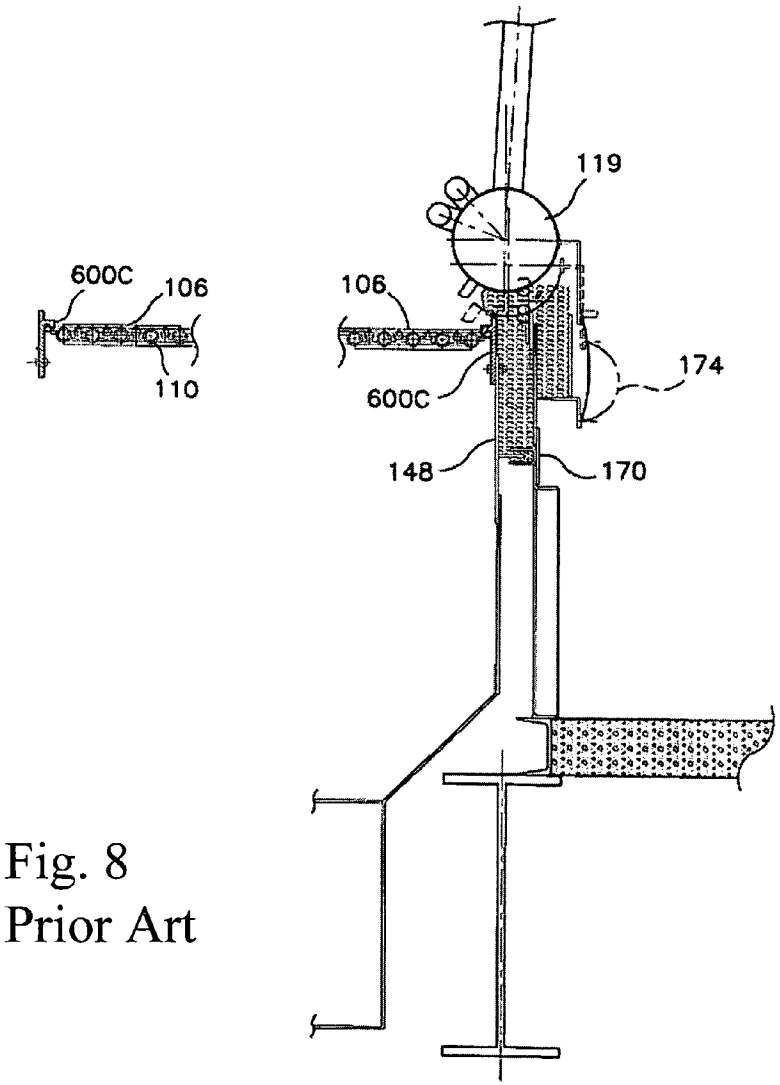
Fig. 8 Prior Art
FIG. 8 is side sectional views taken along line 5-6 of FIG. 1 illustrating a grate to boiler sealing arrangement in accordance with the prior art.

FIG. 5 is a partial cross section of a vibrating grate and companion boiler in accordance with the present invention. The oscillating support structure, described in detail above, is schematically illustrated in FIG. 5 by element 580 for simplicity. The boiler 102 includes a lower sidewall header 530, which supports the sidewall of the boiler and also carries feed water to the boiler. The boiler 102, as illustrated, can be partially supported via the side wall header 530, by a support frame 590. This support 590, as well as the boiler 102, are vibration isolated from the grate surface 106, which, if so embodied, includes the illustrated sloped grate side casting 510. The grate surface 106 and integral plenum 550 are separately supported by the vibrating support 580 to reduce vibration transfer to the boiler 102. Nevertheless, the sloped grate side casting, 510 and a side header casting 520 interact to provide a reliable seal between the grate 106 and the rest of the boiler 102, as described in further detail below.

As best seen in FIGS. 5 and 7A and 7B, for example, the grate surface 106 is provided with upturned lateral edges 511 and may also be provided with a sloped upper surface 513 in the lateral edge regions, in order to urge fuel on the grate toward a centerline of the grate surface 106.

FIGS. 7A and 7B illustrate the lateral edge grate clip 510, which is used in conjunction with other grate clips in order to form a complete grate surface 106. Alternatively, the grate surface can be formed as a unitary component, in which case the edges of the unitary component would have the same general morphology as the illustrated lateral edge grate clip 510. Apertures 517 can be provided in the grate clip 510, as well as throughout the grate surface 106 to enhance fuel combustion by providing combustion air. The lower surface of the grate clip 510 includes a depression 516 formed therein in order to reduce weight while maintaining structural integrity. Further provided are recesses 519, which engage cooling tubes to which the grating is attached. The cooling tubes maintain the temperature of the grate surface 106 within acceptable limits even though combusting material may be sitting on the grate surface.

As the grate 106 is vibrated during use, the fuel on the grate 106 naturally tends to move down the slope of the upper surface 513, toward a centerline of the grate 106. This keeps combusting fuel away from the walls of the boiler 102, including the sidewall header 530, thereby preventing excessive abrasion and premature failure of the header 530 and/or other parts.

Additionally, a side header guard 520 can be provided which further protects the boiler sidewall header 530. The side header guard 520 is arranged between the support 590 and the lower boiler sidewall header 530. The side header guard is bolted to the support 590, and is therefore easily replaceable in case of wear or damage. Such a bolt 541 is illustrated in FIG. 5, while a corresponding bolt hole 527 in the side header guard 520 is illustrated in FIGS. 6A and 6B. The side header guard 520 includes upwardly and downwardly projecting fin portions 521, 523 and a main body flange 525 which sits between the support 590 and the lower boiler sidewall header 530, and allows mechanical attachment to the support 590. The upwardly projecting fin portion 521 is adapted and configured to extend over and protect the lower boiler sidewall header 530 from abrasion by fuel. The downwardly projecting fin portion 523 is adapted and configured to extend over the upturned lateral edge 511 of the lateral edge grate clip 510, forming an interlocking arrangement. This aids in inhibiting passage of fuel therebetween. A compressible, non-combustible insulating material 540 is preferably disposed in the space 599 defined between the side header guard 520 and the lateral edge grate clip 510 to further inhibit passage of fuel and/or combustion gases. This allows for good sealing, while maintaining a space between the vibrating lateral edge grate clip 510 and the stationary side header guard 520. Insulating material is also preferably provided between the sidewall header 530 and the side header guard, so that sealing is maintained when the sidewall header 530 expands downwardly, as the boiler reaches operating temperature. The insulating material which may be a CERWOOL® blanket, for example, is maintained in the space 598 by flanges 559 and 599, which are respectively connected to the grate side frame 555/plenum 108 and to the support 590. A floating isolation element 557, which is substantially T-shaped in the illustrated embodiment, is provided between the two flanges 559, 599, and serves to maintain the insulating material 540 in the space 598 while allowing for vibration isolation between stationary and vibrating components.

The lateral edge grate clip 510 and the stationary side header guard 520 can be made out of any suitable materials such as, but not limited to, metals, including iron, metal alloys, ceramics and high-temperature composite materials.

The invention further includes a boiler adapted and configured to be used with the grating systems and grating seals described hereinabove. The invention also includes methods related to manufacture and use of the grating systems and grating side seals described hereinabove.

The methods and systems of the present invention, as described above and shown in the drawings, provide for a grating system and sidewall seal for grate stoker with superior properties including durability and easy reparability. It will be apparent to those skilled in the art that various modifications and variations can be made in the device and method of the present invention without departing from the spirit or scope of the invention. Thus, it is intended that the present invention include modifications and variations that are within the scope of the appended claims and their equivalents.

What is claimed is:

1. A grate system for a boiler, the grate system comprising:

a grate unit for supporting fuel during combustion thereof, the grate unit having an upper surface and a lower surface and upturned lateral edges; and a side header guard arranged along a side wall of the boiler, the side header guard having upwardly and downwardly projecting fin portions, the upwardly projecting fin portion being adapted and configured to extend over and protect the boiler side wall from abrasion by fuel, the downwardly projecting fin portion being adapted and configured to extend over the upturned lateral edge of the grate unit, inhibiting passage of fuel therebetween, wherein the upper surface of the grate near the outer lateral edges thereof slopes toward a centerline of the grate unit to urge fuel carried thereon away from lateral edges of the grate unit, and wherein the side header guard is vibrationally isolated from the grate unit in at least a vertical direction with respect to the upwardly and downwardly projecting fin portions.

2. The grate system of claim 1, the side header guard further including a main body flange configured and adapted to enable mounting of the side header guard to a grate support frame.

3. The grate system of claim 1, further comprising combustion-proof material arranged between the grating unit and the side header guard, further inhibiting passage of fuel or combustion gases therebetween.

4. The grate system of claim 3, wherein the combustion-proof material is retained in part by a floating isolation element bridging between the grate unit and a support therefor; and wherein the isolation element facilitates the vibrational isolation of the side header guard from the grate unit.

5. The grate system of claim 1, further comprising combustion-proof material arranged between the side header guard and the boiler side wall, inhibiting passage of fuel or combustion gases therebetween.

6. The grate system of claim 1, further comprising air-flow apertures defined in the grate unit to allow air for combustion to pass through the grate unit.

7. The grate system of claim 6, further comprising an air plenum unit positioned under and attached to said grate unit; said air plenum unit adapted and configured to be coupled to an air supply for providing combustion air through said air-flow apertures.

8. The grate system of claim 7, wherein said air plenum unit includes a plurality of zones with each of said zones having an associated air flow control damper for controlling combustion air flow through said zone to said grate surface.

9. The grate system of claim 1, wherein the grate unit comprises a plurality of grate clips.

10. The grate system of claim 1, further comprising a vibration drive isolation assembly associated with said grate unit for vibrating said grate unit and isolating said grate unit from said boiler.

11. The grate system of claim 1, further comprising a plurality of water-cooling pipes supporting the grate unit, said plurality of water-cooling pipes configured and adapted to be coupled to a water supply.

12. The grate system of claim 1, wherein said upper grate surface is disposed generally horizontally and wherein said vibration drive isolation assembly includes a stroke angle of at least 20 degrees from the horizontal.

13. The grate system of claim 1, further comprising a vibration drive isolation assembly for vibrating said grate unit; said vibration drive isolation assembly including a longitudinally extending counterbalance member; a plurality of drive springs supported by said counterbalance member with said drive springs being distributed across at least the width of said grate unit; at least one vibratory drive motor installed on said counterbalance member; and a plurality of isolation springs supporting said longitudinal counterbalance member.

14. The grate system of claim 1, wherein said water-cooled grate unit includes a plurality of water-cooling pipes supporting said grate unit and includes a water-cooling inlet header supplying cooling water to said plurality of water-cooling pipes and a water-cooling outlet header receiving cooling water from said plurality of water-cooling pipes.

15. The grate system of claim 1, wherein the grate unit and side header guard are supported independently from the boiler.

16. The grate system of claim 1, wherein the upwardly and downwardly projecting fin portions of the side header guard define an interior surface of the side header guard that slopes toward the centerline of the grate unit.

17. A grate system for a boiler, the grate system comprising:

a grate unit for supporting fuel during combustion thereof, the grate unit having an upper surface and a lower surface and upturned lateral edges; and a side header guard arranged along a side wall of the boiler, the side header guard having upwardly and downwardly projecting fin portions, the upwardly projecting fin portion being adapted and configured to extend over and protect the boiler side wall from abrasion by fuel, the downwardly projecting fin portion being adapted and configured to extend over the upturned lateral edge of the grate unit, inhibiting passage of fuel therebetween, wherein combustion-proof material is arranged between the grating unit and the side header guard, further inhibiting passage of fuel or combustion gases therebetween; and wherein the side header guard is vibrationally isolated from the grate unit in at least a vertical direction with respect to the upwardly and downwardly projecting fin portions.

18. The grate system of claim 17, wherein the upwardly and downwardly projecting fin portions of the side header guard define an interior surface of the side header guard that slopes toward a centerline of the grate unit.

* * * * *